US006604783B2

(12) United States Patent
Goodson

(10) Patent No.: US 6,604,783 B2
(45) Date of Patent: Aug. 12, 2003

(54) PORTABLE COLLAPSIBLE WORKSTATION

(76) Inventor: David A Goodson, 6327 Round Hill Rd., Charlotte, NC (US) 28211

( * ) Notice: Subject to any disclaimer, the term of this patent is extended or adjusted under 35 U.S.C. 154(b) by 0 days.

(21) Appl. No.: 09/794,195

(22) Filed: Feb. 27, 2001

(65) Prior Publication Data

US 2002/0117879 A1 Aug. 29, 2002

(51) Int. Cl.[7] ..... A47B 39/00
(52) U.S. Cl. ..... 297/170; 297/173; 297/174 R
(58) Field of Search ..... 297/140, 173, 297/174 R, 174 CS, 170, DIG. 6, 135, 188.01

(56) References Cited

U.S. PATENT DOCUMENTS 2,903,311 A * 9/1959 Earhart ..... 108/34
4,883,314 A 11/1989 Sakong
5,161,766 A * 11/1992 Arima ..... 248/447
5,330,248 A 7/1994 Smyly et al.
5,542,360 A 8/1996 Fleming
5,685,602 A * 11/1997 Williams ..... 297/174
5,711,572 A 1/1998 Khan
5,769,514 A 6/1998 Brown et al.
5,820,208 A * 10/1998 Miklinevich ..... 297/159.1
6,012,788 A 1/2000 Marschand et al.
6,033,014 A * 3/2000 Nightengale ..... 297/174
6,044,758 A 4/2000 Drake
6,155,647 A * 12/2000 Albecker, III ..... 297/452.16
6,273,310 B1 * 8/2001 Gregory ..... 224/275

OTHER PUBLICATIONS

Levenger, Lapstation® L–EA0355, 1 page (p. 20).
Levenger, Levenger Lap Desk® L–AC120, L–AC130, 1 page (p. 70).
Laptopper™ L–AC0165, 1 page (p. 29).
Herman Miller, Scooter® L–FD830, 1 page (p. 69).

* cited by examiner

*Primary Examiner*—Peter M. Cuomo
*Assistant Examiner*—Stephanie Harris
(74) *Attorney, Agent, or Firm*—Schwartz Law Firm, P.C.

(57) ABSTRACT

A collapsible workstation includes a seat and table. The table is connected to the seat and defines a working surface adapted for supporting articles above the lap of a user in an in-use position spaced apart from the seat. The table is movable from the in-use position to a non-use collapsed position adjacent the seat for storage and transport. An elongated connecting arm interconnects the seat and the table to enable movement of the table between the in-use position and the non-use collapsed position.

17 Claims, 9 Drawing Sheets

PORTABLE COLLAPSIBLE WORKSTATION

BACKGROUND OF THE INVENTION

This invention relates to a portable collapsible workstation. While the invention is capable of carrying virtually any lightweight article, it has particular application to personal laptop computers for supporting the computer above the lap of a user. The invention provides a stable and secure working surface and a comfortable seat designed to promote hours of continuous, uninterrupted use.

In our present fast-paced, technology-driven society, it has become increasingly more desirable and convenient for persons to carry their work with them outside of the office. This lifestyle has been advanced and encouraged by the rapid development of portable laptop computers. When traveling, for example, whether it be by bus, train, or airplane, a need exists for a sturdy and secure working surface on which to position the computer within the relatively confined seating space provided in these vehicles.

Numerous prior art devices have been developed in an effort to address this need. According to one such device, a table is adapted for positioning on the lap of a user, and includes a memory-foam cushion opposite the top surface which is intended to conform to the user's sitting position. While this device provides a flat working surface, the surface is generally unstable and shifts with each movement of the user. According to another prior art device, a small table is mounted on a vertical support stand for being placed on the floor adjacent the user's chair. This device appears generally cumbersome, difficult to transport, and relatively heavy. Such a device would not be well suited for use on an airplane or bus. A further prior art device includes legs which unfold from opposing side edges of the table to support the table above the lap. Because the overall width of this device appears larger than that typically provided in most vehicle seats and auditoriums, its use in such confined seating areas is generally impractical.

The present invention overcomes these and other limitations of the prior art by providing a portable collapsible workstation which is especially adapted for supporting articles, such as a laptop computer, above the lap of a user seated in a relatively confined seating area. The invention is lightweight, and has a substantially low profile when in the collapsed, non-use position. In this position, the invention is designed to be stored with the laptop computer in a standard computer tote bag, briefcase or book bag. In further applications, the invention may be used as a portable drafting board for draftsmen, an artist's table, or a play surface for children.

BRIEF SUMMARY OF THE INVENTION

Therefore, it is an object of the invention to provide a portable collapsible workstation which is adapted for supporting articles above the lap of a user.

It is another object of the invention to provide a portable collapsible workstation which is especially applicable for carrying a personal laptop computer.

It is another object of the invention to provide a portable collapsible workstation which includes a comfortable seat and table.

It is another object of the invention to provide a portable collapsible workstation which includes a table that will remain substantially stable upon shifting movement by the user.

It is another object of the invention to provide a portable collapsible workstation which is designed to fit in a standard tote bag or briefcase with the laptop computer.

It is another object of the invention to provide a portable collapsible workstation which is relatively lightweight.

It is another object of the invention to provide a portable collapsible workstation which includes relatively few moving parts.

It is another object of the invention to provide a portable collapsible workstation which is designed to support relatively heavy articles.

These and other objects of the present invention are achieved in the preferred embodiments disclosed below by providing a collapsible workstation including a seat and table. The table is connected to the seat and defines a working surface adapted for supporting articles above the lap of a user in an in-use position spaced apart from the seat. The table is movable from the in-use position to a non-use collapsed position adjacent the seat for storage and transport. An elongated connecting arm interconnects the seat and the table to enable movement of the table between the in-use position and the non-use collapsed position. The connecting arm is adapted to extend between the legs of a user positioned on the seat with the table in the in-use position above the According to another preferred embodiment of the invention, the seat and the table are substantially superimposed in overlying registration with the table in the non-use collapsed position.

According to yet another preferred embodiment of the invention, the table defines a ventilation opening therein to promote air circulation between the table and lap of the user.

According to yet another preferred embodiment of the invention, the workstation has a relatively thin profile with the table in the non-use collapsed position adjacent the seat. Preferably, the profile is less than 5 inches, and more preferably, less than 3 inches.

According to yet another preferred embodiment of the invention, the seat includes a cushion for providing added comfort to the user.

According to yet another preferred embodiment of the invention, the cushion is formed of polyurethane foam.

According to yet another preferred embodiment of the invention, a plurality of touch fastener pads are located on the working surface of the table, and adapted for mating with a complementary pads located on an article to be carried on the table.

According to yet another preferred embodiment of the invention, the workstation weighs less than 20 pounds, and preferably less than 10 pounds, and more preferably less than 5 pounds.

According to yet another preferred embodiment of the invention, a connecting arm mounting block is attached to either one of the table and seat for mounting the connecting arm to the table or seat.

According to yet another preferred embodiment of the invention, the connecting arm includes a pivotable mounting base, and the connecting arm mounting block defines a socket therein adapted for receiving and engaging the mounting base.

According to yet another preferred embodiment of the invention, the pivotable mounting base of the connecting arm includes a spring-loaded locking key. The connecting arm mounting block includes a complementary keyway adapted for releasably receiving the locking key to thereby releasably connect the table and seat together.

BRIEF DESCRIPTION OF THE SEVERAL VIEWS OF THE DRAWINGS

Some of the objects of the invention have been set forth above. Other objects and advantages of the invention will appear as the description proceeds when taken in conjunction with the following drawings, in which.

DETAILED DESCRIPTION OF THE INVENTION

Figure 1:
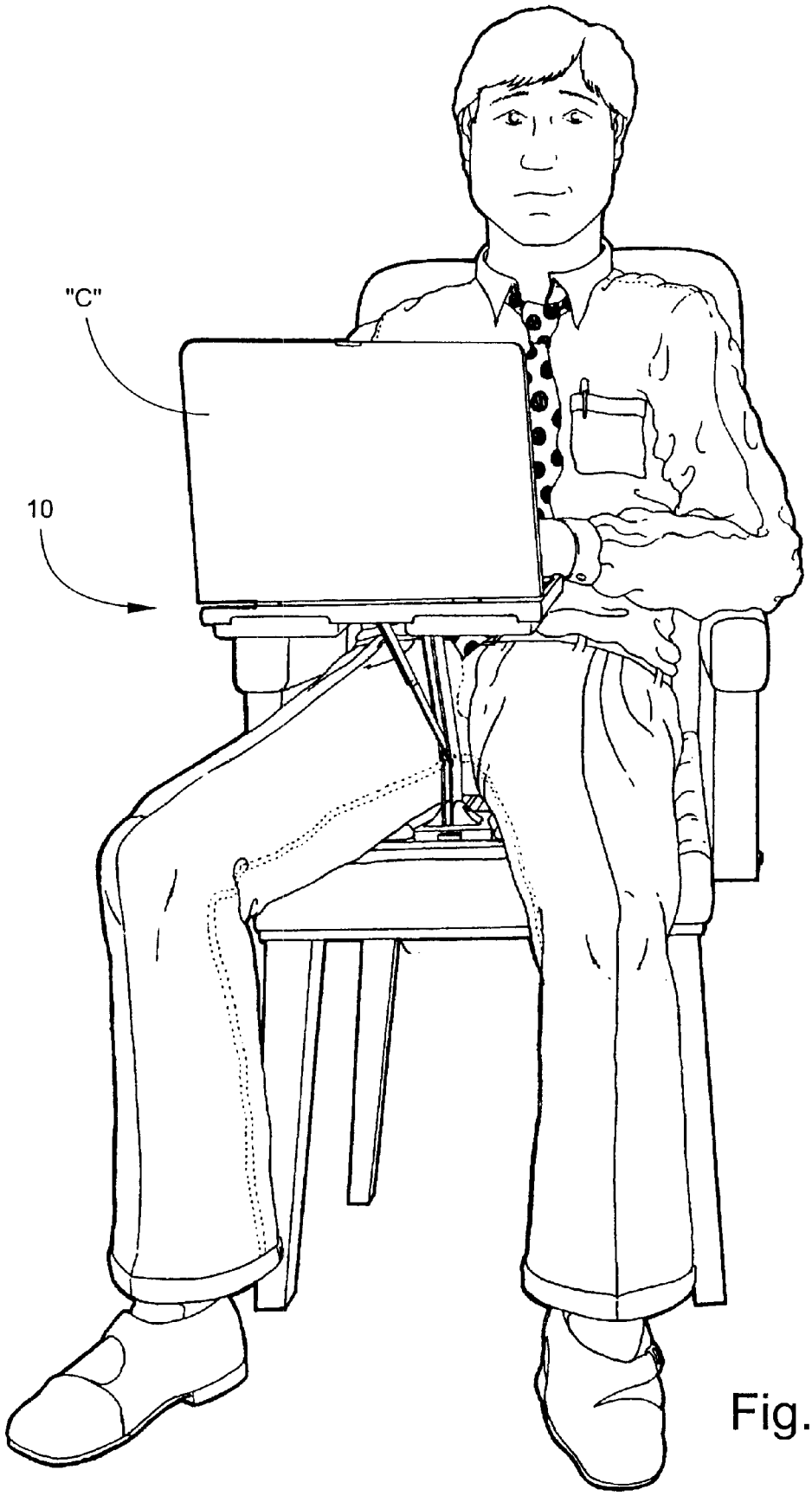
FIG. 1 is an environmental perspective view of the workstation according to one preferred embodiment of the invention, and showing the workstation in use carrying a personal laptop computer above the lap of a user.
Figure 2:
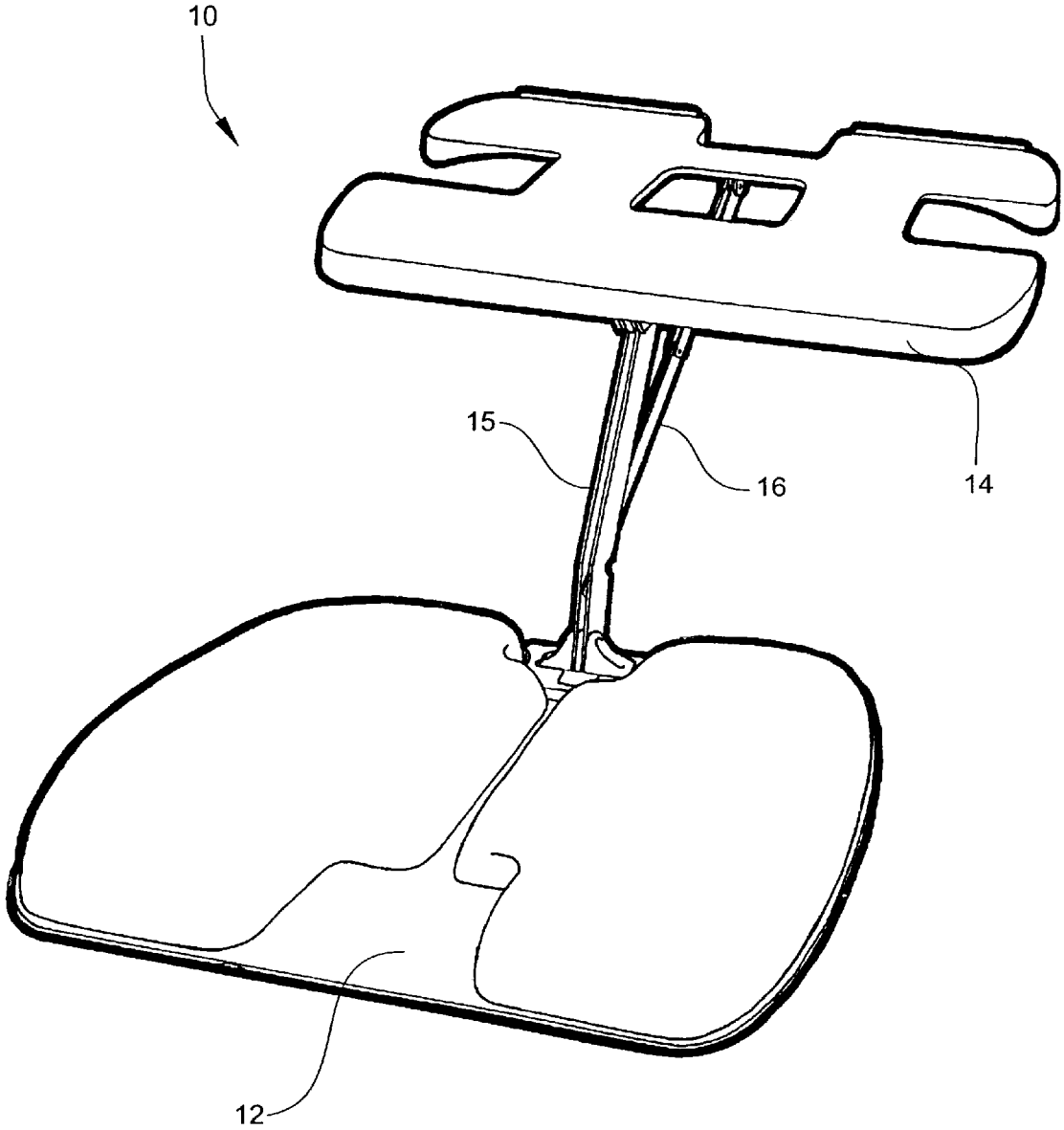
FIG. 2 is rear perspective view of the workstation in the opened, in-use position.

Referring now specifically to the drawings, a portable collapsible workstation according to the present invention is illustrated in FIG. 1 and shown generally at reference numeral 10. The workstation 10 is especially useful for supporting articles, such as a personal laptop computer "C", above the lap of a user seated in a relatively confined space such as that provided in an airplane, bus, or auditorium. The workstation 10 converts from an open in-use position, shown in FIGS. 1 and 2, to a collapsed non-use position shown in FIG. 3. In the collapsed position, the workstation 10 is adapted to fit with the laptop computer "C" inside a conventional tote bag or brief case. The profile of the workstation 10 in the collapsed position is preferably less than 3 inches. The total weight of the workstation 10 is preferably less than 10 pounds.

Figure 4:
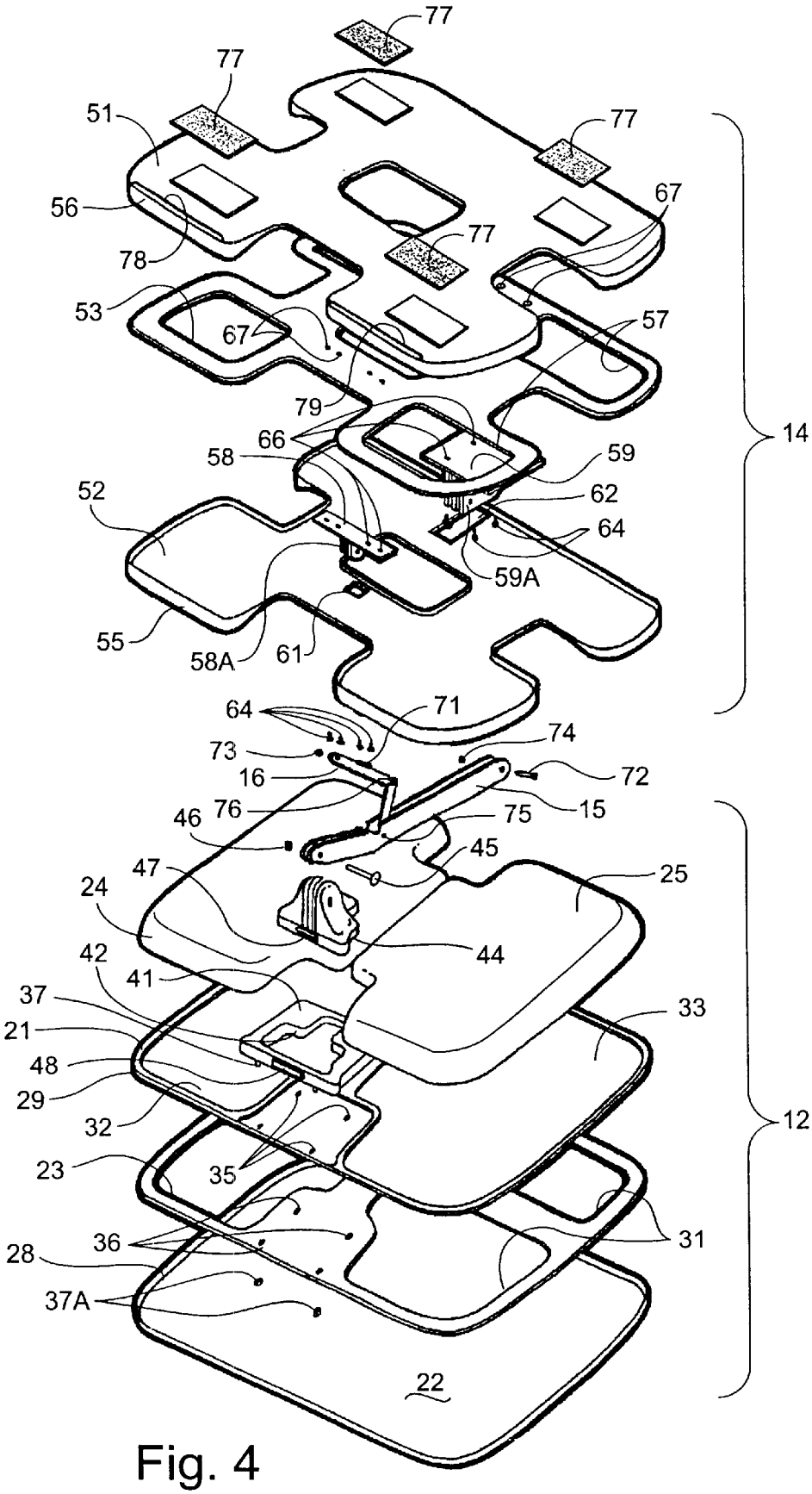
FIG. 4 is a fully exploded perspective view of the workstation in the opened position.
Figure 5:
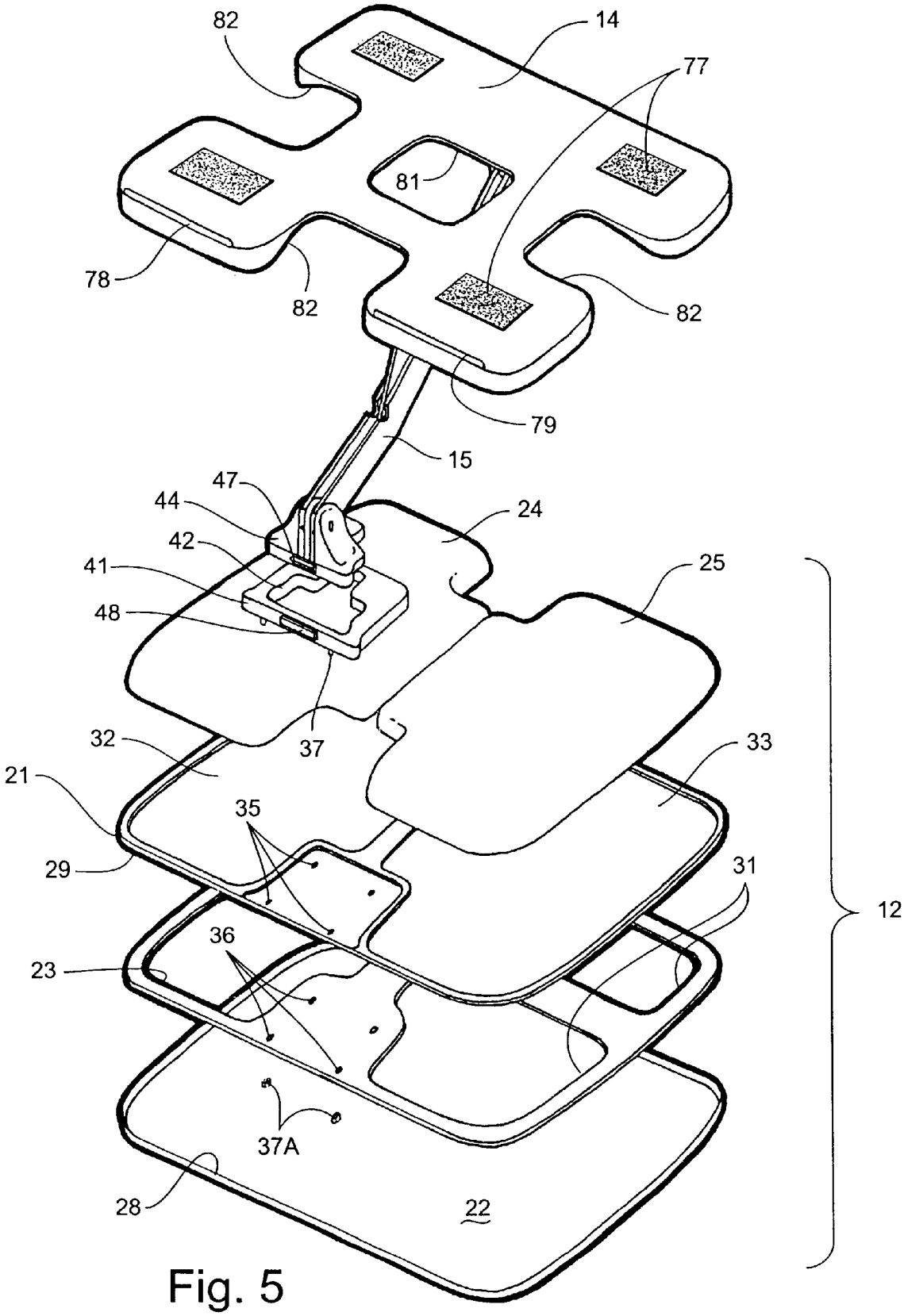
FIG. 5 is a perspective view of the workstation in the opened position with the seat exploded to further illustrate its internal construction.

Referring to FIGS. 2, 4, 5 and 6, the workstation 10 includes a seat 12 and table 14 connected together by an elongated rigid connecting arm 15. The connecting arm 15 is pivotably attached at its opposite ends to the seat 12 and table 14, respectively, and cooperates with a pivoted support bar 16 to enable movement of the workstation 10 between the in-use and non-use positions. As best shown in FIGS. 4 and 5, the seat 12 is formed of a composite assembly including molded top and bottom plastic seat sections 21 and 22, a metal reinforcing frame 23 located between the seat sections 21, 22, and a pair of foam rubber seat cushions 24 and 25. The bottom seat section 22 has a raised perimeter lip 28 adapted to be snap-attached to a complementary perimeter 29 formed with the top seat section 21. The reinforcing frame 23 strengthens the seat 12, while defining a number of open areas 31 for minimizing the overall weight of the workstation 10. Contoured recesses 32 and 33 are formed in the top seat section 21 for receiving and positioning the seat cushions 24 and 25. To facilitate replacement when necessary, the seat cushions 24 and 25 may be removably attached using mating hook and loop touch fasteners or other suitable attachment means (not shown). The top seat section 21 and reinforcing frame 23 further include small holes 35 and 36 aligned in registration for receiving rivets 37 used to attach a connecting arm mounting block 41 to the seat 12. Corresponding ends 37A are fixed to each of the rivets 37.

The connecting arm mounting block 41 defines a generally T-shaped socket 42 adapted to receive a pivotable base 44 of the connecting arm 15 to releasably lock the connecting arm 15 to the seat 12. The connecting arm 15 is pivotably attached to the base 44 using a complementary pin 45 and nut 46. The connecting arm base 44 includes a spring-loaded key 47 which releasably locks the connecting arm 15 to the mounting block 41 of the seat 12. A release button 48 is provided on the mounting block 41 for being depressed by the user to disengage the locking key 47 from an internal keyway in the socket 42 in order to separate the connecting arm 15 and table 14 from the seat 12. The opposite end of the connecting arm 15 is permanently attached to the table 14.

Figure 6:
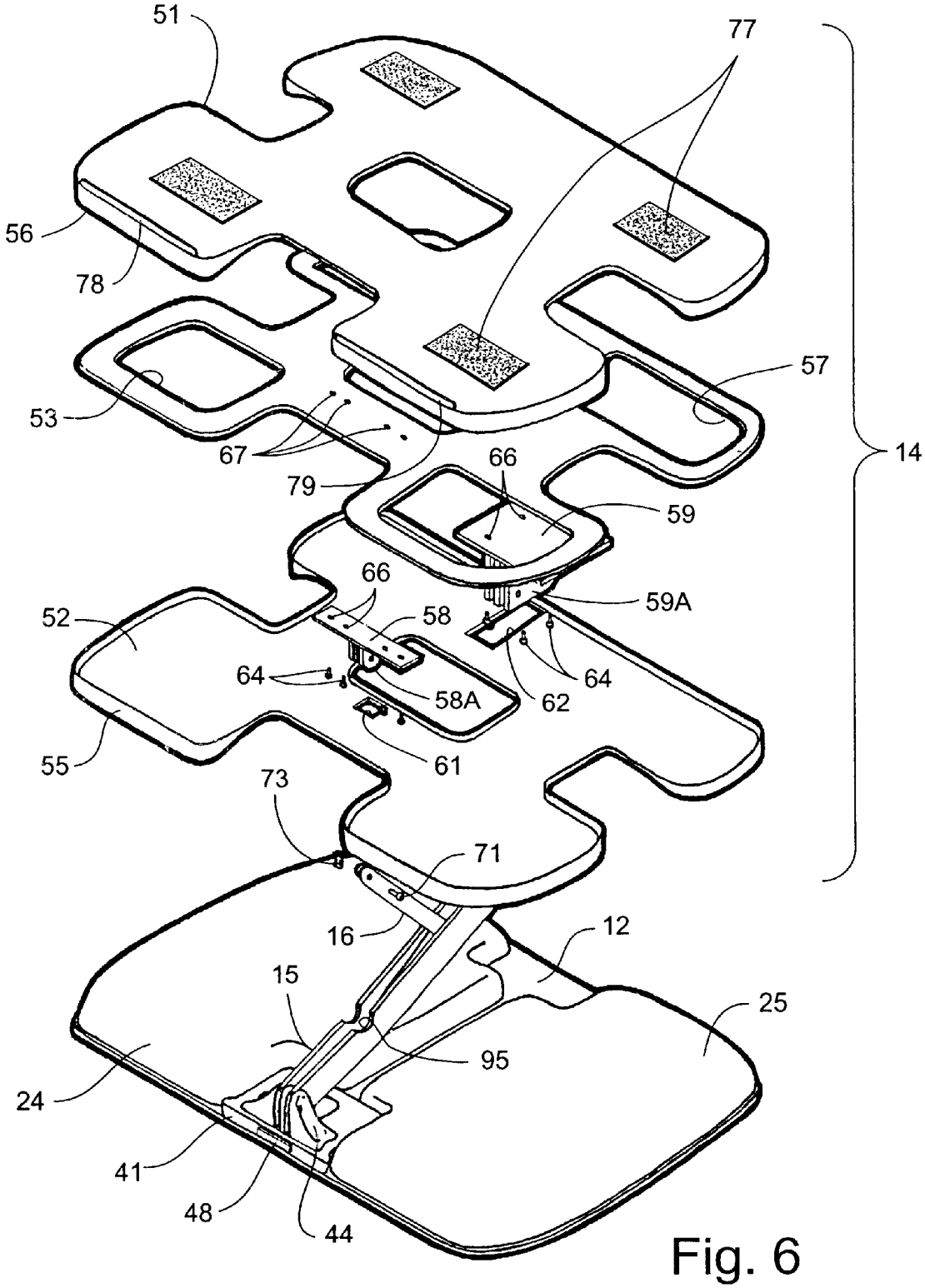
FIG. 6 is a perspective view of the workstation in the opened position with the table exploded to further illustrate its internal construction.

As best shown in FIGS. 4 and 6, the table 14 of the workstation 10 is likewise formed of a composite assembly including top and bottom molded plastic table sections 51 and 52, and a metal reinforcing frame 53 located between the table sections 51, 52. The bottom table section 52 includes a raised perimeter lip 55 adapted to be snap-attached to a complementary perimeter 56 formed with the top table section 51. The reinforcing frame 53 strengthens the table 14, while defining a number of open areas 57 for minimizing the overall weight of the workstation 10. Front and rear mounting plates 58 and 59 are positioned between the reinforcing frame 53 and bottom table section 52, and include respective downwardly-turned mounting flanges 58A and 59A. The mounting flanges 58A and 59A extend outwardly through openings 61 and 62 in the bottom table section 52, and are attached to the reinforcing plate 53 using rivets 64 extending through respective aligned holes 66 and 67. Respective ends of the support bar 16 and connecting arm 15 are pivotably connected to the mounting flanges 58A and 59A using complementary pins 71, 72 and bolts 73, 74. The opposite end of the support bar 16 is carried on a pivot pin 75 secured to the connecting arm 15. The support bar 16 bends at a friction pivot point 76 upon movement of the table 14 between the in-use and collapsed positions.

The top surface of the table 14 preferably includes texture pads 77 and raised front edges 78 and 79 for holding the computer or other article in position during use. In one embodiment, the texture pads 77 are touch fastener pads adapted for mating with complementary pads attached to the computer to firmly secure the computer to the table 14. As best shown in FIG. 5, a center ventilation opening 81 and side indentions 82 are preferably formed with the table 14 to promote air circulation above the lap of the user. These features further add to the pleasing aesthetics of the workstation 10, and reduce its overall weight.

Figure 7:
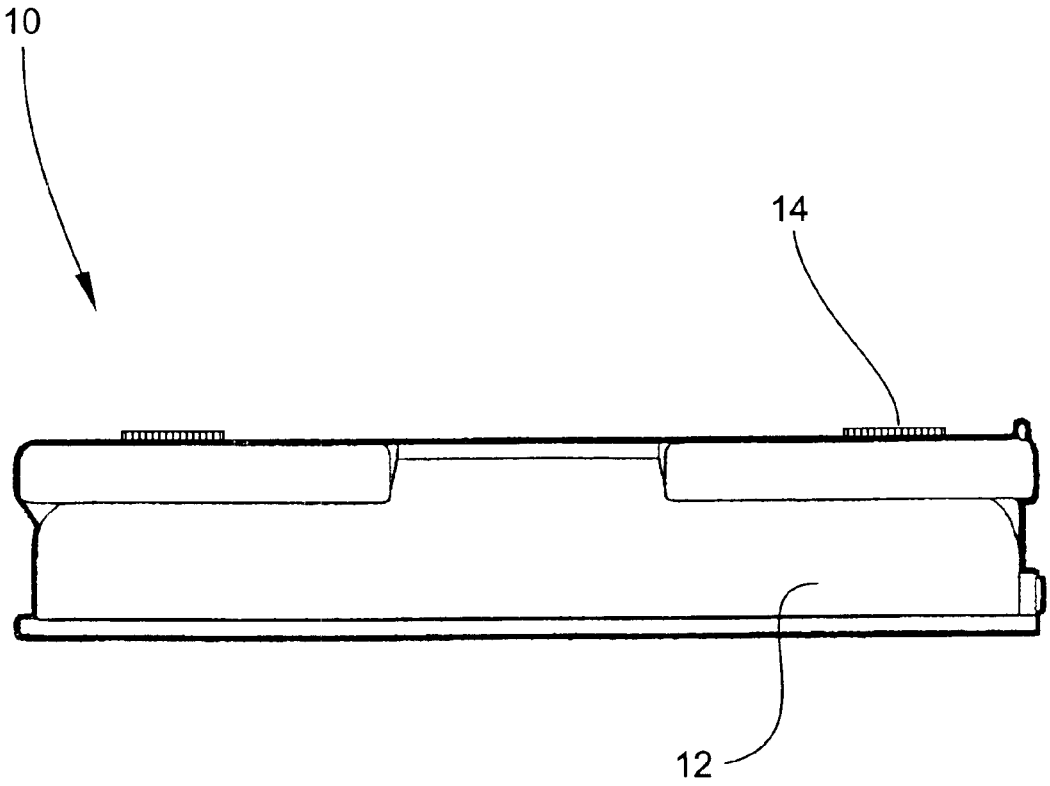
FIG. 7 is a side elevation of the workstation in the collapsed, non-use position.
Figure 8:
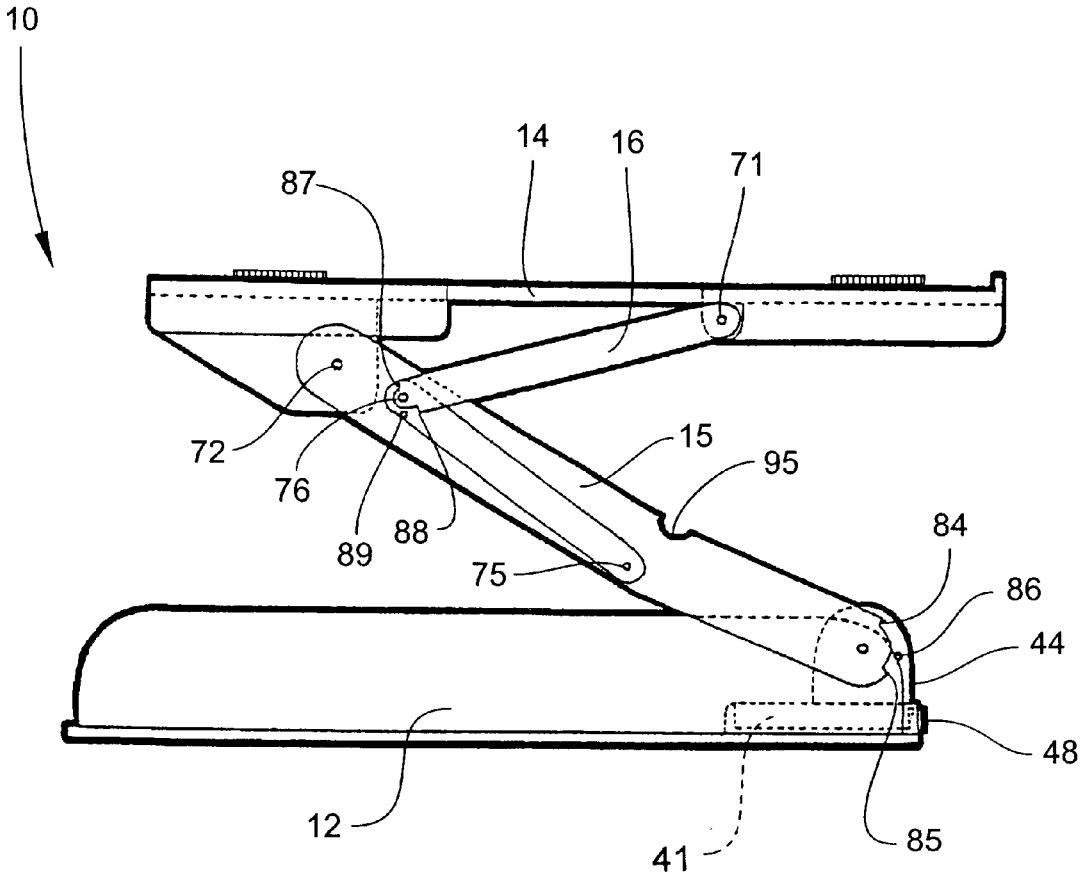
FIG. 8 is a side elevation of the workstation moved halfway between the collapsed, non-use position and the opened, in-use position.
Figure 9:
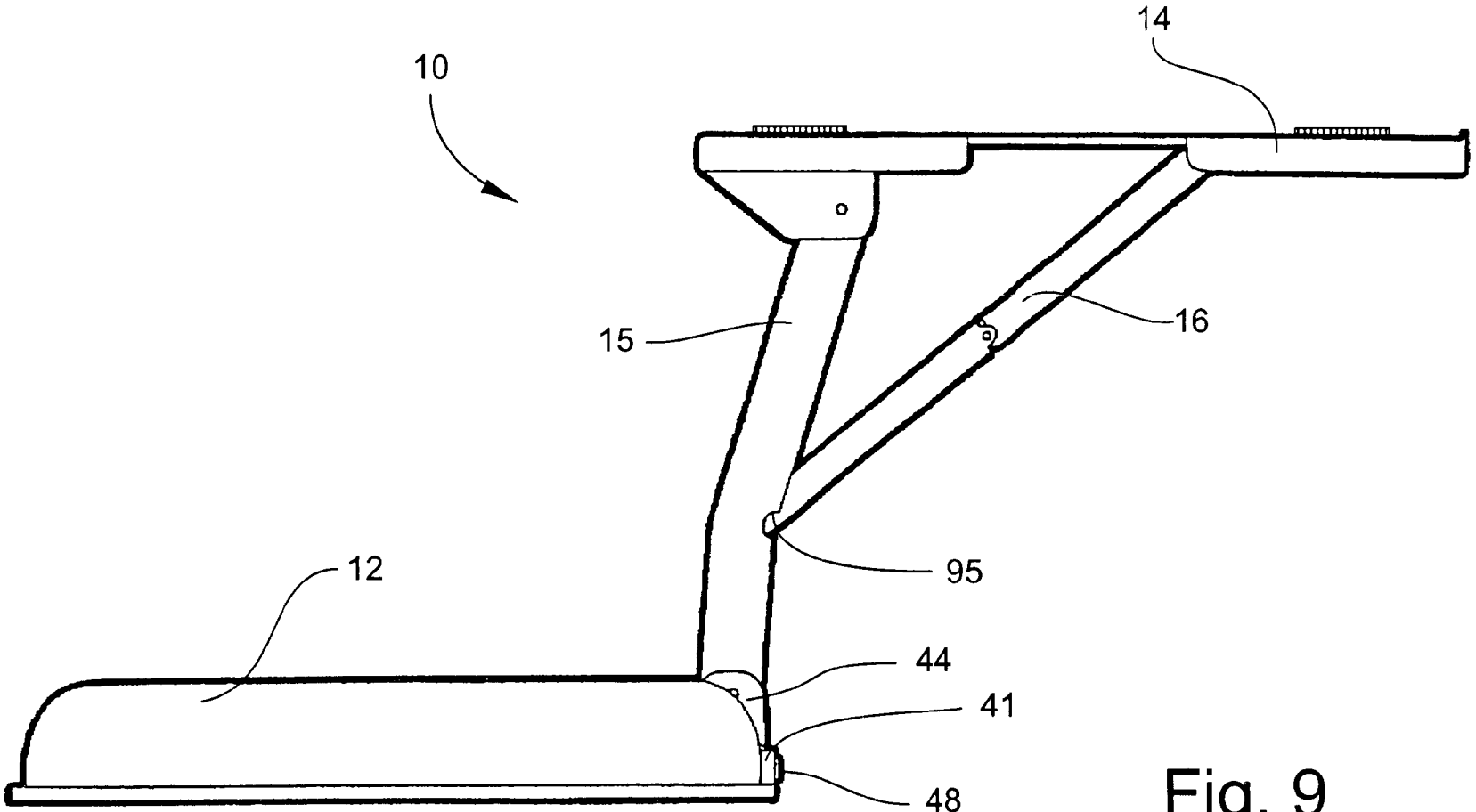
FIG. 9 is a side elevation of the workstation in the opened, in-use position.

FIGS. 7, 8, and 9 demonstrate movement of the workstation 10 from the non-use collapsed position to the opened in-use position. From the collapsed position shown in FIG. 7, the front edge of the table 14 is lifted upwardly and outwardly away from the seat 12 pivoting about the pin 72 of the connecting arm 15, as shown in FIG. 8. The opposite end of the connecting arm 15 pivots at the mounting base 44, while the support bar 16 pivots simultaneously about its connecting pins 71, 75 and pivot point 76. FIG. 8 illustrates the workstation 10 opened halfway between the collapsed and in-use positions. Spaced apart shoulders 84 and 85 formed with the bottom end of the connecting arm 15 cooperate with a stop 86 protruding from the mounting base 44 to control the range of pivoting movement of the connecting arm 15. Spaced apart shoulders 87 and 88 formed adjacent the pivot point 76 of the support bar 16 cooperate with a similar stop 89 to control the range of movement of the support bar 16. Further upward and outward movement of the table 14 into the fully opened in-use position straightens and locks the support bar 16 with the connecting arm 15 extending substantially vertical relative to the seat 12, as shown in FIG. 9. In this position, the table 14 is spaced approximately 8–12 inches from the seat 12, and projects outwardly from a front edge of the seat 12 for positioning over the lap of the user. The connecting arm 15 is adapted to extend between the legs of the user, and may be released from the mounting block 41 of the seat 12 to remove the connecting arm 15 and table 14 when entering and exiting the workstation 10. The connecting arm 15 and table 14 are conveniently released from the seat 12 by depressing the release button 48 on the mounting block 41, as previously described. Once seated on the seat 12, the user then reattaches the connecting arm 15 and table 14 by inserting the mounting base 44 back into the socket 42 (See FIG. 5) of the mounting block 41.

Figure 3:
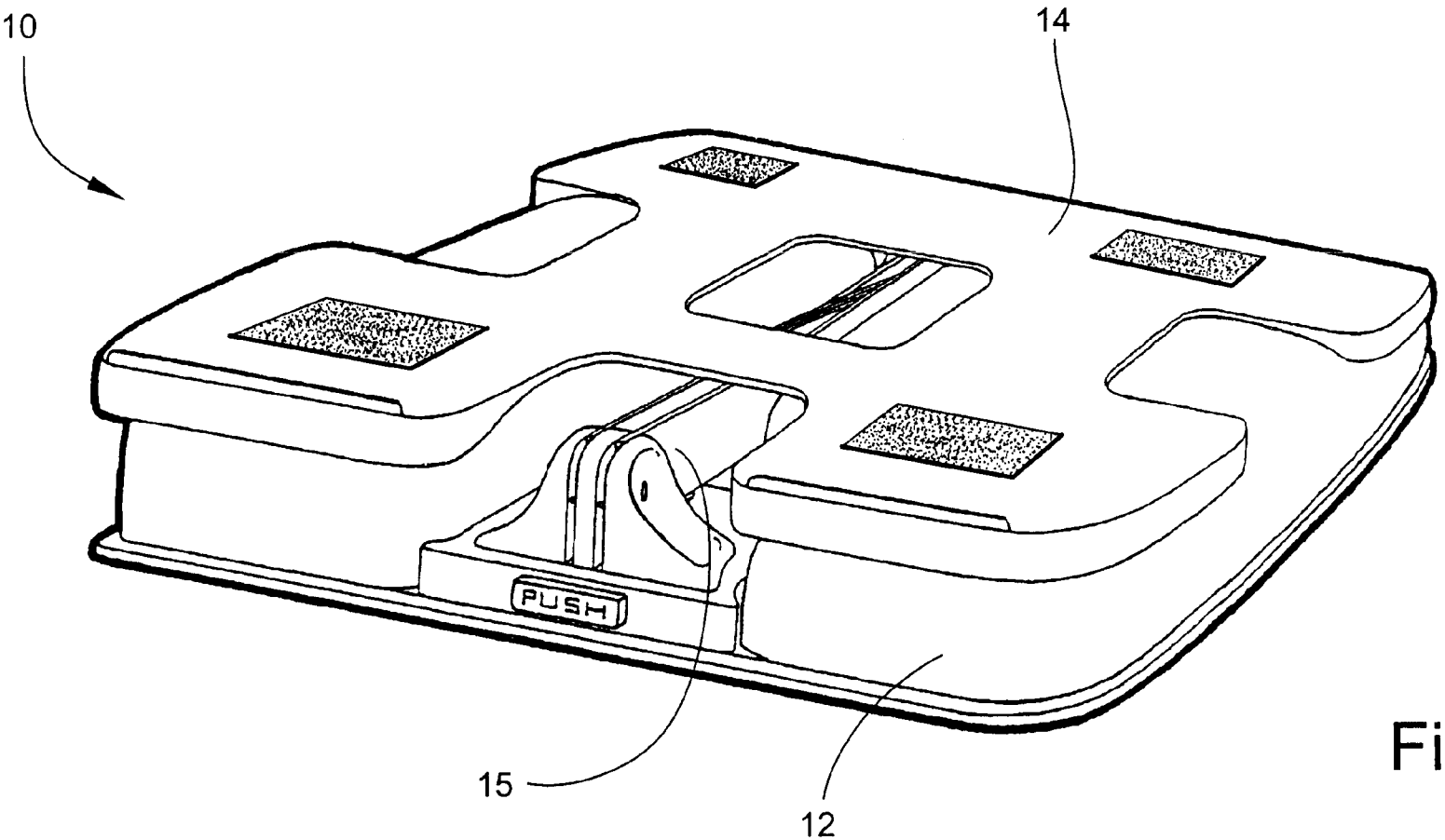
FIG. 3 is a front perspective view of the workstation in the collapsed, non-use position.

In the collapsed, non-use position shown in FIG. 7, the table 14 and seat 12 are substantially superimposed in overlying registration such that the table 14 covers a portion of the seat 12 (See FIG. 3). A bottom of the table 14 resides closely adjacent a top major surface of the seat 12 with the connecting arm 15 sandwiched between the table 14 and seat 12. An arcuate notch 95, best shown in FIG. 6, is formed in the connecting arm 15 to accommodate the support bar mounting flange 58A, while the connecting arm 15 extends between the seat cushions 24 and 25. This allows the table 14 to fit closely adjacent the seat 12. According to one embodiment, the dimensions of the workstation 10 in the collapsed position are approximately 11×12 inches with a thin profile of approximately 2.25 inches. The workstation 10 weighs approximately 6 pounds, and is engineered to support articles weighing as much as 25 pounds. In a further application of the invention, the workstation 10 may be used as a drafting board and may include accessories, such as a pencil holder and detachable work light. The seat of the workstation may include nothing more than an inverted T-shaped stabilizing bar adapted for being positioned under the legs of the user to secure and stabilize the table. In addition, the connecting arm may alternatively have a telescoping configuration enabling extension and retraction to move the workstation between the in-use and non-use positions.

A portable collapsible workstation is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A collapsible workstation, comprising:

(a) a seat having a major surface upon which a user can be seated;

(b) a table connected to said seat and defining a working surface adapted for supporting articles above the lap of the user in an in-use position spaced apart from said seat, and said table being movable to a non-use collapsed position adjacent said seat for storage and transport; and (c) an elongated connecting arm interconnecting said seat and said table for enabling movement of said table between the in-use position and the non-use collapsed position, said connecting arm adapted for extending between the legs of a user positioned on said seat with said table in the in-use position above the lap, and said connecting arm being sandwiched between said seat and said table with said table in the non-use collapsed position, and in the non-use collapsed position, said table residing in substantially superimposed, overlying registration with the major surface of said seat to cover a portion of said seat.

2. A collapsible workstation according to claim 1, wherein said table defines a ventilation opening therein to promote air circulation between the table and lap of the user.

3. A collapsible workstation according to claim 1, wherein said workstation has a relatively thin profile with said table in the non-use collapsed position adjacent said seat, said profile being less than 3 inches.

4. A collapsible workstation according to claim 1, wherein said seat comprises a cushion for providing added comfort to the user.

5. A collapsible workstation according to claim 4, wherein said cushion is formed of foam.

6. A collapsible workstation according to claim 1, and comprising a plurality of touch fastener pads located on the working surface of said table, and adapted for mating with a complementary pads located on an article to be carried on said table.

7. A collapsible workstation according to claim 1, wherein said workstation weighs less than 10 pounds.

8. A collapsible workstation according to claim 1, and comprising a connecting arm mounting block attached to either one of said table and seat for mounting said connecting arm to said table or seat.

9. A collapsible workstation according to claim 8, wherein said connecting arm comprises a pivotable mounting base, and wherein said connecting arm mounting block defines a socket therein adapted for receiving and engaging said mounting base.

10. A collapsible workstation according to claim 9, wherein said pivotable mounting base of said connecting arm comprises a spring-loaded locking key, and wherein said connecting arm mounting block comprises a complementary keyway formed adjacent said socket and adapted for releasably receiving said locking key to thereby releasably connect said table and seat together.

11. A collapsible workstation, comprising:

(a) a seat having a major surface upon which a user can be seated;

(b) a table connected to said seat and defining a working surface adapted for supporting articles above the lap of the user in an in-use position spaced apart from said seat, and said table being movable to a non-use collapsed position adjacent said seat for storage and transport, and wherein said workstation weighs less than 10 pounds and has a profile of less than 3 inches with said table in the non-use collapsed position; and (c) an elongated connecting arm interconnecting said seat and said table for enabling movement of said table between the in-use position and the non-use collapsed position, and said connecting arm being sandwiched between said seat and said table with said table in the non-use collapsed position, and in the non-use collapsed position, said table residing in substantially superimposed, overlying registration with the major surface of said seat to cover a portion of said seat.

12. A collapsible workstation, comprising:

(a) a seat having a major surface upon which a user can be seated;

(b) a table connected to said seat and defining a working surface adapted for supporting articles above the lap of the user in an in-use position spaced apart from said seat, and further defining a ventilation opening therein to promote air circulation between the table and lap of the user, and said table being movable from the in-use position to a non-use collapsed position adjacent said seat for storage and transport, and wherein said workstation has a profile of less than 3 inches with said table in the non-use collapsed position; and (c) an elongated connecting arm interconnecting said seat and said table for enabling movement of said table between the in-use position and the non-use collapsed position, said connecting arm adapted for extending between the legs of a user positioned on said seat with said table in the in-use position above the lap, and said connecting arm being sandwiched between said seat and said table with said table in the non-use collapsed position, and in the non-use collapsed position, said table residing in substantially superimposed, overlying registration with the major surface of said seat to cover a portion of said seat.

13. A collapsible workstation according to claim 12, wherein said connecting arm is adapted for being permanently secured at one end thereof to either of said table and said seat, and releasably secured at an opposite end thereof to the other of said table and said seat.

14. A collapsible workstation according to claim 12, and comprising a connecting arm mounting block attached to either one of said table and seat for mounting said connecting arm to said table or seat.

15. A collapsible workstation according to claim 14, wherein said connecting arm comprises a pivotable mounting base, and wherein said connecting arm mounting block defines a socket therein adapted for receiving and engaging said mounting base.

16. A collapsible workstation according to claim 15, wherein said pivotable mounting base of said connecting arm comprises a spring-loaded locking key, and wherein said connecting arm mounting block comprises a complementary keyway formed adjacent said socket and adapted for releasably receiving said locking key to thereby releasably connect said table and seat together.

17. A collapsible workstation according to claim 12, and comprising a plurality of touch fastener pads located on the working surface of said table, and adapted for mating with a complementary pads located on an article to be carried on said table.

* * * * *